United States Patent [19]

Khayat et al.

[11] 4,310,575

[45] Jan. 12, 1982

[54] METHOD OF INCREASING THE CORROSION RESISTANCE OF ENAMEL COATED STEEL

[75] Inventors: Ali Khayat, Carlsbad; Klaus P. Redenz, Poway, both of Calif.

[73] Assignee: Ralston Purina Company, St. Louis, Mo.

[21] Appl. No.: 238,386

[22] Filed: Feb. 25, 1981

Related U.S. Application Data

[63] Continuation-in-part of Ser. No. 141,077, Apr. 17, 1980, abandoned.

[51] Int. Cl.[3] ..... B05D 1/38; B05D 3/02

[52] U.S. Cl. ..... 427/409; 427/410

[58] Field of Search ..... 427/410, 409; 556/410, 556/411, 436

[56] References Cited

U.S. PATENT DOCUMENTS

| | | | |
|---|---|---|---|
| 3,052,568 | 9/1962 | Sites et al. | 427/54.1 |
| 3,397,220 | 8/1968 | Klebe | 556/436 |
| 3,454,418 | 7/1969 | Forsberg | 428/497 |
| 3,467,686 | 9/1969 | Creamer | 556/411 |
| 3,497,466 | 2/1970 | Markulin et al. | 428/416 |
| 3,701,795 | 10/1972 | Holub et al. | 556/411 |
| 4,165,242 | 8/1979 | Kelly et al. | 427/410 |

*Primary Examiner*—John H. Newsome

*Attorney, Agent, or Firm*—Joseph M. Hageman

[57] ABSTRACT

A method of increasing the corrosion resistance of enamel coated steel by the application of a silyation agent in an effective amount to prevent the corrosion of enamel coated steel products is disclosed. This invention is particularly suited for the prevention of the interaction of a canned food product with its container.

8 Claims, 2 Drawing Figures

METHOD OF INCREASING THE CORROSION RESISTANCE OF ENAMEL COATED STEEL

This is a continuation in part of application Ser. No. 141,077, filed Apr. 17, 1980 now abandoned.

BACKGROUND OF THE INVENTION

This invention relates generally to a method of increasing the corrosion resistance of pre-treated steel, and more particularly, to a method of treating the interior enamel of steel containers suitable for packing food.

Many types of corrosion resistant materials are utilized for coating steel. Alkali metal silicate is used to coat metal and glass as described in U.S. Pat. No. 3,526,530. U.S. Pat. No. 3,730,746 shows that preparation of a silicate polymer as a protective coating for metal. A method of coating a corrosible steel substrate having an oxidized steel coating with a solution of an alkyl silicate is disclosed in U.S. Pat. No. 4,071,380. The alkyl silicate coating is allowed to cure before a top coating is applied. This process insures the maintenance of the oxidized steel coating as an integral component in a system for inhibiting corrosion. The porous character of a fully cured or hydrolyzed alkyl silicate is called upon to provide passage for oxygen and water for effecting corrosion inhibiting oxidizing action with the underlining steel substrate, with the resultant oxidized steel being retained within the pores of the inorganic cured solution as an integral part of the film. Additionally, the alkyl silicate may function as a vehicle or binder for a mixture of dry, inert particulate matter which facilitates the silicate application of the solution by its particular color and aids the appearance of the subsequently applied top coat by smoothing the surface. U.S. Pat. No. 3,983,305 discloses a process for treating cold, rolled steel having a residual oil coating in a manner to provide an effective binding substrate for an organic protective coating. The surface of cold rolled steel has a relatively low corrosion resistance and relatively poor organic coating characteristics. Therefore, it is coated with oil and subjected to heat treatment until the corrosion resistance and the organic coating characteristics of the resultant heat treated steel are improved. The heat treated steel is then cooled to prevent further thermal degradation of the rolling oil to produce a residual film on the heat treated steel surface. In conventional methods, many steps are required before applying an organic protective coating: efficient cleaning, heating to decompose the oil, removal of the residual oil or other contaminants, and then applying a temporary protective coating.

In the food industry, the interior of the enamel coated steel containers is attacked by the food product resulting in the oxidation of the steel container and/or the formation of salt deposits which discolors the steel, and are clearly visible to the consumer. There is a need for further protecting the steel after conventional protective coatings have been applied to improve the corrosion resistance characteristics of the steel.

SUMMARY OF THE INVENTION

It is an object of the present invention to provide a method of increasing the corrosion resistance of enamel coated steel.

A further object of the present invention is to provide a method of increasing the corrosion resistance of enamel coated steel food containers in such a manner to prevent the interaction of a canned food product with its container.

The present invention comprises coating the surface of an enamel coated steel with an effective amount of a silyation agent. The silyation agent is then bonded to the enamel coated steel to prevent the corrosion of the steel.

DETAILED DESCRIPTION

Figure 1:
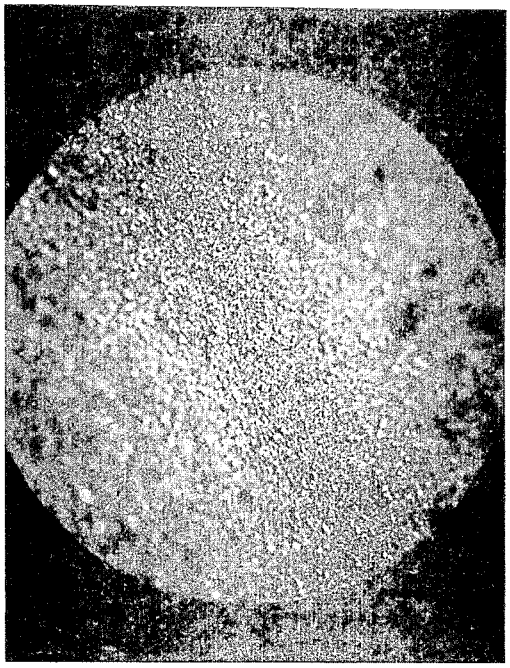
FIG. 1 shows a gas phase portion of an enamel coated container treated with a silyation agent at 32× magnification.

Prior to the present invention, an entirely satisfactory process was not available to the food industry for the protection of enamel coated steel. Techniques have been developed for improving the organic coating of the steel or the surface of the steel for receiving the organic coating, but corrosion problems still exist.

Oil is applied to flat rolling steel to prevent oxidation. This is usually removed prior to coating the steel with an organic protective agent, such as enamel. After application of enamel, the steel is formed into containers for food packaging. During the container forming process, the enamel may undergo extreme stress to such a degree that cracking and flaking may occur that is often undetectable. When the containers are filled with a food product and that product interacts with the steel, salt formation and oxidation may occur. The present invention comprehends a method of treating enamel coated steel to prevent the interaction of a food product with the steel.

In accordance with the present invention, a silyation agent is applied on the enamel coated steel to improve the corrosion resistance thereof. The silyation agent is then bonded, usually by heating, to render the enamel non-polar and resistant to later corrosion of the steel.

In resolving the corrosion problem is the food industry, it has been found that many commercially available enamels cannot withstand the stresses applied during can formation. Therefore, with no intention to be unduly limitative, the term "enamel" may be defined as any commercially available paint or enamel coating intended to be applied on steel surface which may be in contact with food products. Particularly, enamels comprising epoxy phenolic resins can be utilized and are preferred. The free hydroxyl group on the phenol is a suitable binding site for the silyation agents. Additional enamels readily available commercially that can be used with the process of the present invention include those that have any suitable site of attachment for the silyation agents, such as a free amine group, etc.

The silyation agent can be any one that is commercially available. It should also be the type which can be easily attached to the epoxy phenolic resins found in enamels used for coating the interior of steel food containers. The term "silyation" is usually used to abbreviate "trimethylsilyation". It is also used to designate the attachment of similar organosilicone groups such as dimethylsilyl [$—SiH(CH_3)_2$] or chloromethyldimethylsilyl [$—SiCH_2Cl\ (CH_3)_2$]. With no intention to limit the present invention, the following are some suitable silyation agents that can be utilized: Trimethylsilyl [$Si(CH_3)_3$], as N,O-bis-(TMS)-acetamide, commonly abbreviated TMS. This compound is sometimes designated a completely trimethylsilyated compound, as "TMS-sucrose" or "TMS-leucine". This is incorrect nomenclature but frequently used; N,O-Bis-(trimethylsilyl)-acetamide $CH_3C[OSi(CH_3)_3]{=}NSi(CH_3)_3$, commonly abbreviated BSA; Chloromethyldimethylchlorosilane, $(CH_2Cl)(CH_3)_2SiCl$; N,O-bis (dimethylsilyl-acetamide, $CH_3$ C $[OSiH(CH_3)_2]{=}NSiH(CH_3)_2$, a dimethylsilyating reagent, etc. A preferred silyation agent is BSA.

The amount of silyation agent should be an amount effective to produce a corrosion resistant layer on the steel surface. The silyation agent penetrates the porous structure of the enamel to prevent the corrosion of the steel. The material interacts with the enamel to render it non-polar. This amount can be readily determined by a skilled worker in the art. The amount of the silyation agent should be in a thickness ranging from about 1 to about 10 micrograms per square inch. This range however, is merely given as a guideline for skilled workers, and is in no way intended to be limiting.

EXAMPLE

Figure 2:
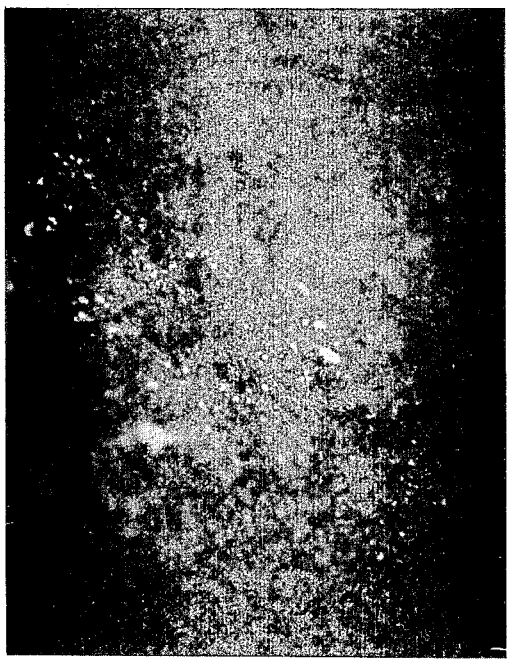
FIG. 2 shows the gas phase portion of an enamel coated container that had not been coated with the silyation agent at 32× magnification.

Number 307×112 cans were formed from rolled flat steel previously coated with an epoxy phenolic resin base enamel supplied by Mobil Oil Company. The cans were cleaned by washing with heptane in order to free them from any lubricant or grease. The cans were then washed with a soap solution followed by distilled water and then they were dried. A few containers were then set aside to serve as a control. Into the remaining containers, the silyation agent, N,O-bis-(trimethylsilyl) acetamide, was poured. The silyation agent was applied on the enamel surface of each container in an amount of about 8 micrograms per square inch. The containers were then drained. Next, the containers were allowed to set at a temperature of 50° C. for 60 minutes. A specially prepared test solution had been formulated beforehand. This test solution was formulated to show in a relatively short period, about 3 days, if there were any lack of resistance to corrosion of the interior coating. The test solution had the following composition:

Soldium Chloride—2.5%
Acetic Acid—1.2%
Glucose—1.0%
Methionine—0.05%
Sodium Sulfide—0.05%
Water—Balance Both the cans with the surfaces treated with silyation agents and the cans left untreated as controls were rinsed with the above described test solution. Then, the cans were filled with test solution and retorted at 232° F. for 132 minutes. After retorting the containers were after 3 days inspected. FIG. 1 shows the gas phase portion of a container. By gas phase, it is meant that space normally not occupied by food content. There are no gas pockets, rust spots, or black deposits for these cans which were treated with silyation agents. The spots present are filling compounds which have migrated and deposited on top of the enamel. The magnification of the photomicrograph is 32×. FIG. 2 shows the gas phase portion of a container which was not treated with silyation agents. The large rust spots and gas pockets are clearly visible. The magnification of photomicrographs is also 32×.

The use of silyation agents as clearly illustrated by the above two photomicrographs can prevent the occurrence of undesirable large rust spots and gas pockets. Thus, the use of silyation agents is effective in increasing the corrosion resistance of enamel coated steel used in food cans and other uses.

An alternative embodiment of the present invention is to use steel which has not been coated before can formation. The enamel coating is applied to the interior of the can, usually by spraying. The enamel coating then must be cured, usually by heating the can. Having described the present invention with reference to the specific embodiments, it is to be understood that numerous variations may be made without departing from the spirit of the present invention and it is intended to encompass such measurable variations or equivalence within the scope thereof.

What is claimed is:

1. A method of increasing the corrosion resistance of enamel coated steel comprising:

coating the surface of the enamel coated steel with an effective amount of a silyation agent, and bonding said silyation agent to said enamel coated steel to prevent the corrosion of said enamel coated steel.

2. The method of claim 1 wherein the corrosion resistant material is selected from the group consisting of N,O-Bis-(trimethylsilyl)-acetamide, chloromethyldimethylchlorosilane, and N,O-bis (dimethylsilyl) acetamide.

3. The method of claim 1 wherein the silyation agent is applied at a level of about 1 microgram/square inch to about 10 microgram/square inch.

4. The method of claim 1 wherein said silyation agent is bonded to said enamel coated steel by being subjected to heat.

5. A method of preventing the interaction of a canned food product with its container comprising applying a first coating of enamel to the inside of the container, drying the enamel, coating the surface of said enamel with an effective amount of a silyation agent, and bonding said silyation agent to said enamel coated container to prevent the corrosion of said container.

6. The method of claim 1 wherein the silyation agent is selected from the group consisting of N,O-Bis-(trimethylsilyl)acetamide, chloromethyldimethylchlorosilane, and N,O-bis (dimethylsilyl) acetamide.

7. The method of claim 5 wherein the silyation agent is applied at a level of about 1 microgram/square inch to about 10 microgram/square inch.

8. The method of claim 5 wherein the silyation agent is bonded by being subjected to heat.

* * * * *